US007093893B1

(12) United States Patent
Bunde

(10) Patent No.: US 7,093,893 B1
(45) Date of Patent: Aug. 22, 2006

(54) FOLDING BENCH

(76) Inventor: Gary Bunde, 8237 Lyric Dr., Pensacola, FL (US) 32514

( * ) Notice: Subject to any disclaimer, the term of this patent is extended or adjusted under 35 U.S.C. 154(b) by 76 days.

(21) Appl. No.: 10/893,717

(22) Filed: Jul. 19, 2004

(51) Int. Cl.
*A47C 4/00* (2006.01)

(52) U.S. Cl. ..... 297/17; 297/183.5; 297/188.01

(58) Field of Classification Search ..... 297/183.5, 297/188.01, 452.63, 17, 16.1, 129; 108/35, 108/36, 11, 129, 130
See application file for complete search history.

(56) References Cited

U.S. PATENT DOCUMENTS

| | | | | |
|---|---|---|---|---|
| 14,873 | A | 5/1856 | Lyford | |
| 22,371 | A | 12/1858 | Lewis | |
| 58,462 | A | 10/1866 | Nellis | |
| 134,149 | A | 12/1872 | King | |
| 175,005 | A | 3/1876 | Arnold | |
| 324,320 | A | 8/1885 | Hansen | |
| 353,923 | A | 10/1886 | Conwell | |
| 517,756 | A | 7/1894 | Maurer | |
| 564,711 | A | 7/1896 | O'Brien | |
| 984,529 | A | 2/1911 | Bereman | |
| 1,060,295 | A | 4/1913 | Stiles | |
| 1,287,444 | A | 12/1918 | Rudy | |
| 1,370,732 | A | 3/1921 | Corbett | |
| 1,530,726 | A | 3/1925 | Koenigkramer | |
| 1,558,087 | A | 10/1925 | Haney | |
| 1,762,580 | A * | 6/1930 | Menk | 190/8 |
| 2,086,463 | A | 7/1937 | Bram | |
| 2,260,478 | A | 10/1941 | Peter | |
| 2,508,627 | A | 5/1950 | Spiegel et al. | |
| 2,618,524 | A | 11/1952 | Hoffman | |
| 2,643,926 | A | 6/1953 | Pucci | |
| 2,652,300 | A * | 9/1953 | Graber et al. | 108/93 |
| 2,693,258 | A | 11/1954 | Fleisch | |
| 2,715,558 | A | 8/1955 | Bell | |
| 2,747,957 | A | 5/1956 | Lencioni | |
| 2,755,153 | A | 7/1956 | Pucci et al. | |
| 2,759,576 | A | 8/1956 | Towsend | |
| 2,827,352 | A | 3/1958 | Boyajian | |
| 2,871,076 | A | 1/1959 | Mell | |
| D196,299 | S | 9/1963 | Tedder | |
| 3,878,797 | A | 4/1975 | Patterson | |
| 4,064,812 | A | 12/1977 | Commanda | |
| D290,560 | S | 6/1987 | Carrabba | |
| 5,009,170 | A | 4/1991 | Spehar | |
| 5,120,111 | A * | 6/1992 | Cook | 297/452.41 |
| 5,357,872 | A | 10/1994 | Wilmore | |
| 5,524,555 | A | 6/1996 | Fanuzzi | |
| 5,535,683 | A | 7/1996 | Novak | |
| 5,676,062 | A | 10/1997 | Lloyd | |
| D420,527 | S | 2/2000 | Pinch et al. | |
| 6,032,585 | A | 3/2000 | Pinch | |
| 6,058,853 | A | 5/2000 | Pinch | |
| 6,334,400 | B1 | 1/2002 | Nien | |
| D469,623 | S | 2/2003 | Norbut, Jr. | |

* cited by examiner

*Primary Examiner*—Milton Nelson, Jr.
(74) *Attorney, Agent, or Firm*—Peter Loffler

(57) ABSTRACT

A folding bench that can be sat on and hold food thereon and transport food and other objects has a pair of substantially similar halves hingedly connected to each other. Each half has a frame with a slatted seating surface. A leg is foldably attached to each frame and folds within the confines of the frame when the bench is closed for transport and unfolds when the bench is open and in use. As the two halves come together to close the bench, an interior space is formed which interior space can hold various objects. Retaining apparatus can be located on one or both halves for securing the objects securely within the interior space. Each half has a handle which may have one or more arcuate openings that can hold a cylindrical object such as a drink cup.

20 Claims, 4 Drawing Sheets

FOLDING BENCH

BACKGROUND OF THE INVENTION

1. Field of the Invention

The present invention relates to a folding bench that folds into a compact carrying case which has internal capacity to carry items within the case.

2. Background of the Prior Art

When the weather is pleasant, picnickers are to be found everywhere. Pack a lunch into a basket or similar carrying item, find a nice spot, unpack and enjoy. On particularly gorgeous weekend days, some parks and recreation areas find picnickers jockeying for the best spots. Picnicking is one of life's great yet relatively inexpensive pleasures. The classic picture of picnicking has a person sitting with his favorite girl on a blanket with a picnic basket and food spread everywhere. While this classic model continues to be widely employed, many fans of the picnic arts are adding an increment of sophistication to the sport of picnicking.

Many picnickers desire to have the food sit off of the ground, including off of the blanket spread on the ground so that ants and other ground crawling bugs do not share in the festivities as well as to prevent certain open containers from being easily spilled on a relatively uneven ground surface. Some picnickers want to sit off of the ground either because the ground is wet and will soak through a covering blanket, or due to the passage of years, sitting on the ground becomes increasingly difficult (or at least getting up from the sitting position at the end of the day).

One solution to the sophisticated picnicker's dilemma is to picnic at established picnicking sites. Such sites tend to have tables, chairs, and sometimes other paraphernalia such as grills, roof cover, water supply, etc. While this may prove adequate to some, others find them too restricting. The tables and chairs are located at a fixed location which may not be at the most desirable spot, or even at a very desirable spot. Such spots tend to have multiple users giving a crowded feeling to all. Many such sites tend to be built over a concrete ground covering which detracts from the feeling of being outdoors. Although relatively comfortable, such sites are avoided by the more dedicated of picnickers.

To overcome an "urban" picnic experience, yet to obtain elevation above the ground for food, picnickers, or both, many picnickers bring a table and/or chairs along with their food so that above ground seating or serving can be accommodated. The problem with this approach is that the picnickers are loaded up like Santa at Christmas with chairs and tables and food and anything else desired at the picnic. If the picnic ground is some distance from the parking spot, the portage may prove anything but relaxing in each direction. To combat this problem, several devices have been proposed that allow packing of multiple picnic items in a single bundle for relatively easy transport. However, many such carriers are themselves bulky and difficult to transport or are difficult to get into and out of a typical automobile. Other such devices tend to be relatively complicated in design and manufacture making such devices relatively expensive to purchase thereby effectively eliminating the devices from a large portion of the picnicking public.

Accordingly, there exists a need in the art for a device that brings sophistication to the average picnic by allowing food to be served off of the ground and off of a blanket spread on the ground and by allowing the picnickers to sit off of the ground and blanket. Such a device must be able to carry needed picnicking items without the device being bulky or difficult to transport or to load or unload into a typical vehicle. Such a device must be of relatively simple design and construction so that it is readily affordable to a wide segment of the picnicking public.

SUMMARY OF THE INVENTION

The folding bench of the present invention addresses the aforementioned needs in the art. The folding bench is a device that brings sophistication to the average picnic by allowing food to be served off of the ground and off of a blanket spread on the ground and by allowing the picnickers to sit off of the ground and blanket. The folding bench can carry needed picnicking items and is not bulky or difficult to transport. The folding bench is relatively easy to load and unload into a typical vehicle. The folding bench is of relatively simple design and construction so that it is inexpensive and affordable to a wide segment of the picnicking public. Ease of operation of the folding bench is inherent in its design.

The folding bench of the present invention is comprised of a first frame member that has a first end, a second end, a first top, and a first bottom. A first leg is foldably attached to the first frame member such that the first leg articulates between a folded position wherein the first leg is stored within the confines of the first frame member and an unfolded position wherein the first leg extends downwardly from the first bottom of the first frame member. A first seating surface is attached to the first top of the first frame member. A second frame member has a third end that is hingedly attached to the first end, a fourth end, a second top, and a second bottom. A second leg is foldably attached to the second frame member such that the second leg articulates between a folded position wherein the second leg is stored within the confines of the second frame member and an unfolded position wherein the second leg extends downwardly from the second bottom of the second frame member. A second seating surface is attached to the second top of the second frame member. The bench articulates between a closed position wherein the first leg and the second leg are each in the folded position and the first bottom of the first frame member faces and abuts the second bottom of the second frame member and an open position wherein the first leg and the second leg are each in the unfolded position and the first seating surface and the second seating surface are located on the same plane an uninterrupted seating area. The first frame member is latched to the second frame member when the folding bench is in the closed position. An appropriate retaining means is attached to either the first frame member, the second frame member, or both, for retaining objects within an interior space formed by the abutting first frame member and the second frame member whenever the folding bench is in the closed position. The retaining means may comprise a strap, a bungee cord, a clip, etc. A first handle portion is attached to the second end of the first frame member while a second handle portion is attached to the fourth end of the second frame member. The first handle portion has a first arcuate opening and the second handle has a second arcuate opening that corresponds with the first opening whenever the bench is in the closed position such that the first opening and the second opening are each adapted to receive a cylindrical object therein for holding (e.g. a cup holder). The first seating surface comprises a plurality of first slats arranged in parallel with each other while the second seating surface comprises a plurality of second slats arranged in parallel with each other and with the plurality of first slats.

BRIEF DESCRIPTION OF THE DRAWINGS

Similar reference numerals refer to similar parts throughout the several views of the drawings.

DESCRIPTION OF THE PREFERRED EMBODIMENT

Figure 1:
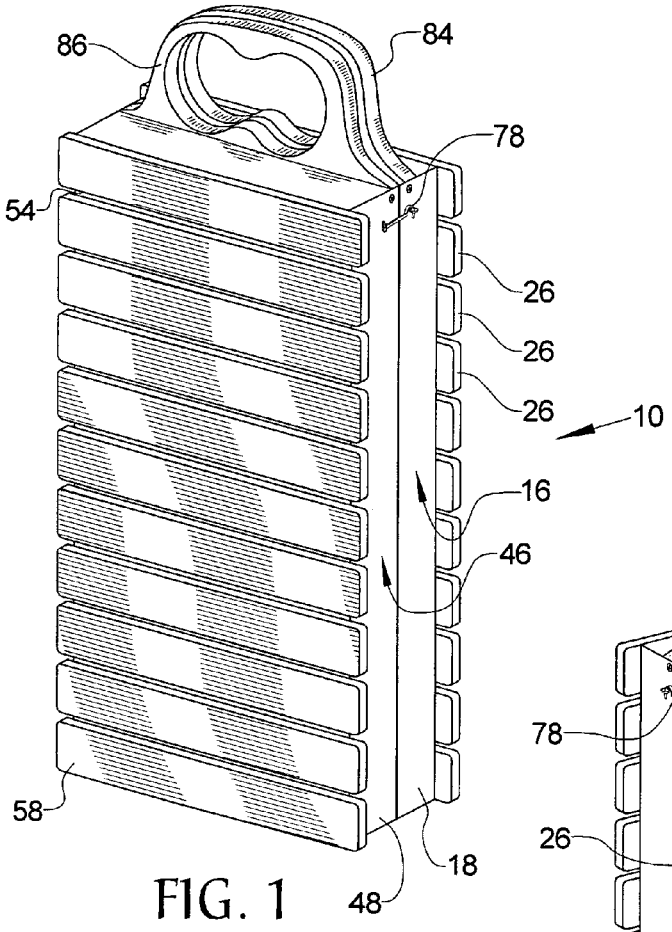
FIG. 1 is a left side perspective view of the folding bench of the present invention.
Figure 2:
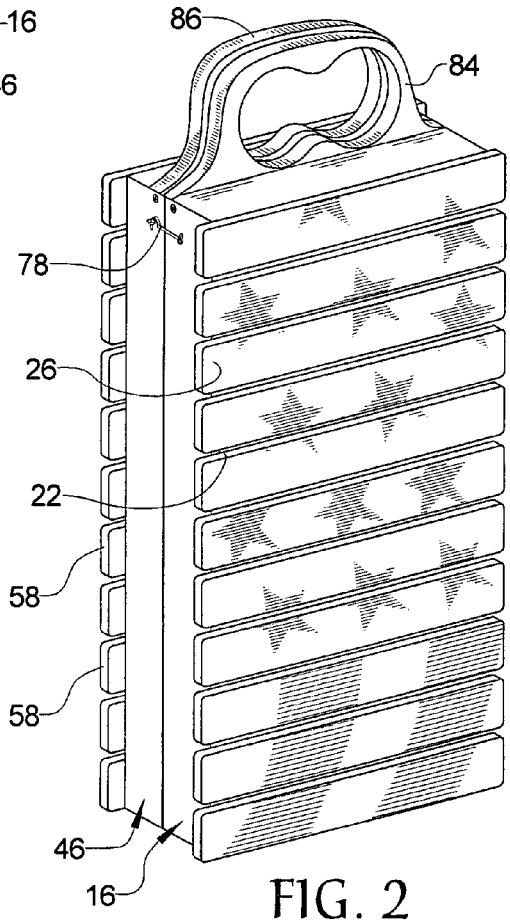
FIG. 2 is a right side perspective view of the folding bench of the present invention.
Figure 3:
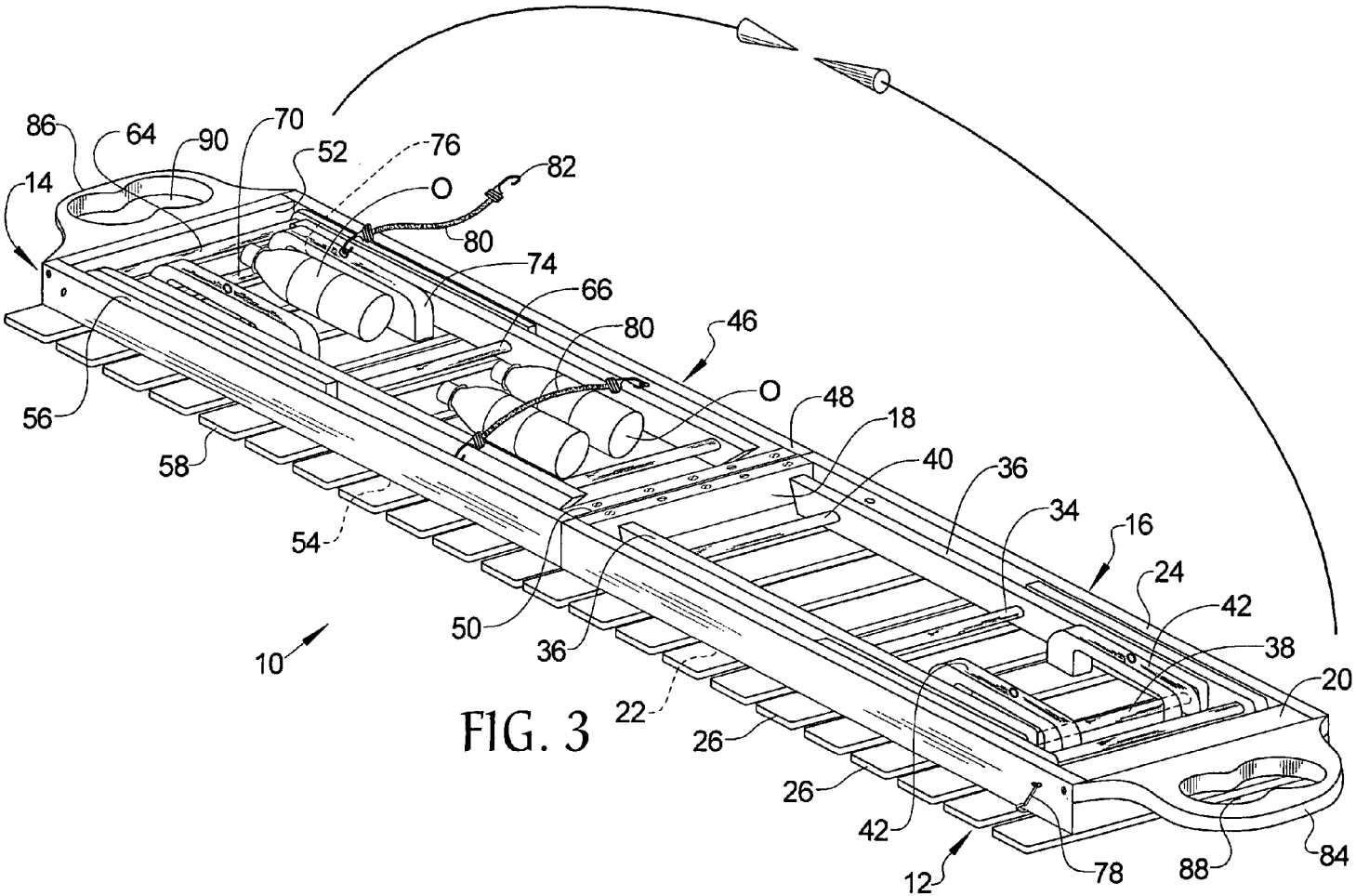
FIG. 3 is a bottom perspective view of the folding bench in a partially unfolded position.
Figure 4:
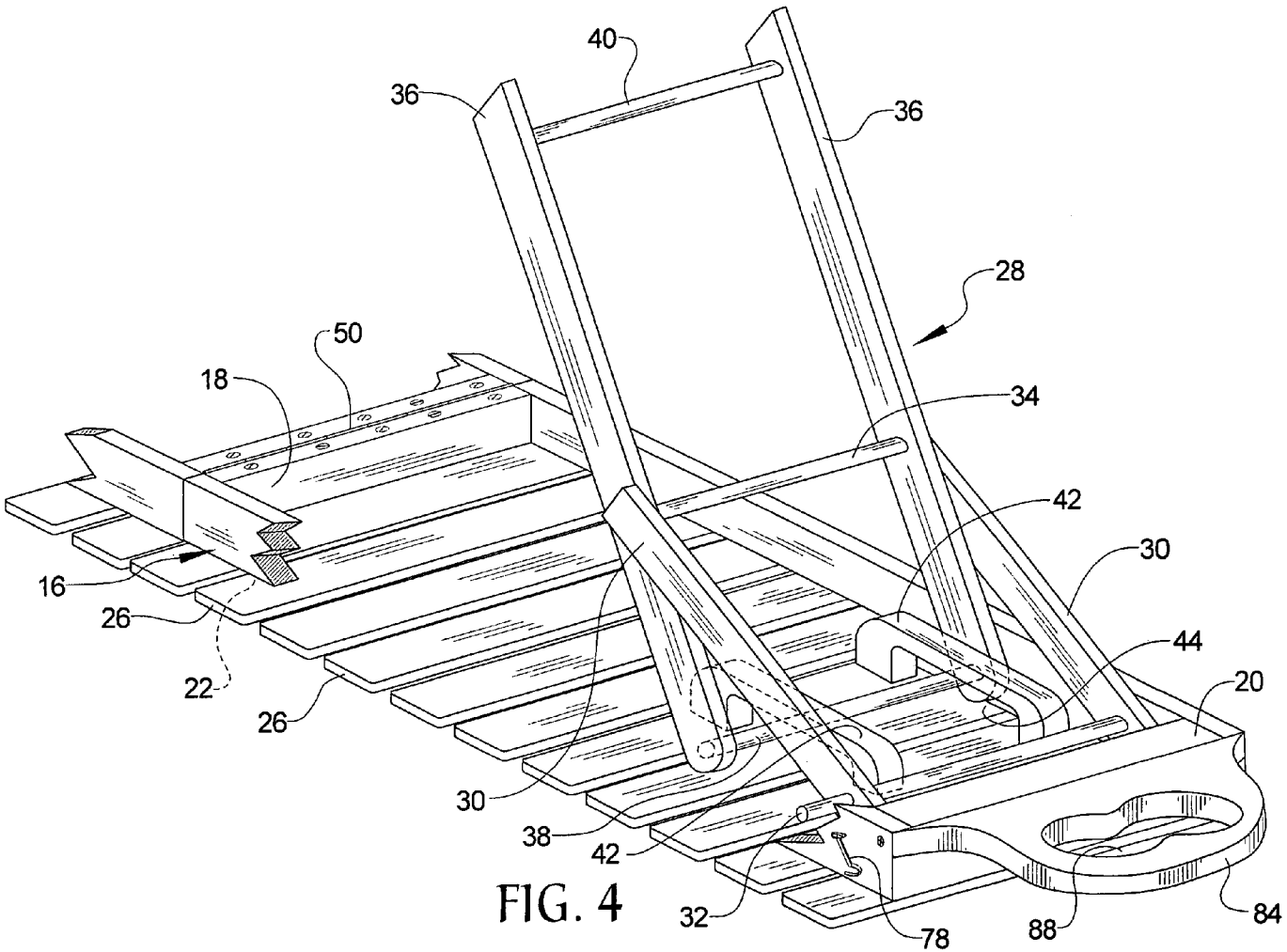
FIG. 4 is a perspective view of the leg pivot/bracket detail.
Figure 5:
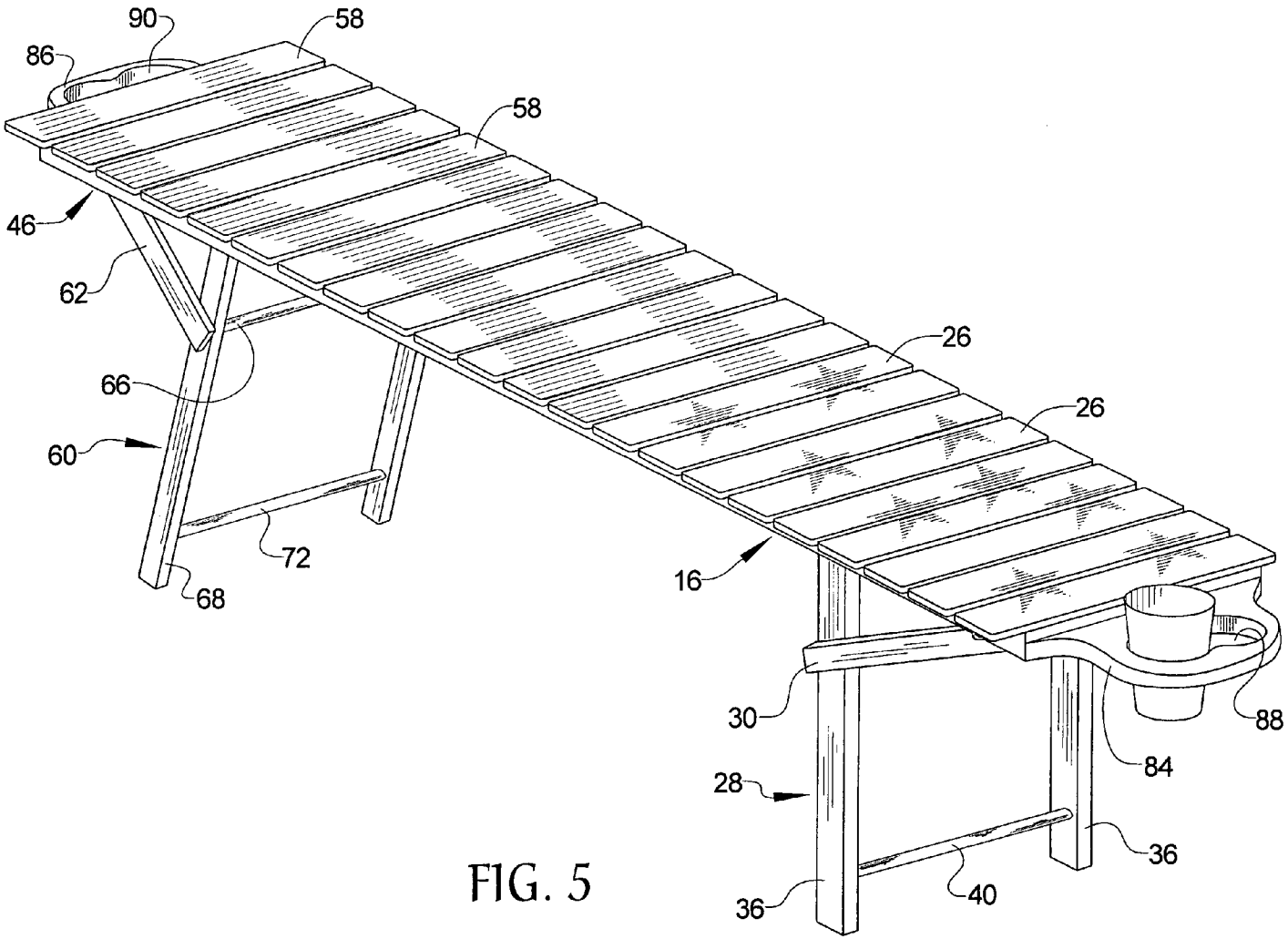
FIG. 5 is a perspective view of the folding bench in an unfolded position.

Referring now to the drawings, it is seen that the folding bench of the present invention, generally denoted by reference numeral 10, is comprised of a pair of substantially similar halves 12 and 14 with the first half 12 comprised of a first frame member 16 that has a first end 18, a second end 20, a first top 22, and a first bottom 24. A first seating surface is attached to the first top 22 of the first frame member 16. As seen, the first seating surface comprises a plurality of parallel first slats 26 arranged transverse to the longitudinal sides of the first frame member 16 and having spaces between each slat 26. A first leg 28 is foldably attached to the first frame member 16 such that the first leg 28 articulates between a folded position wherein the first leg 28 is stored within the confines of the first frame member 16 and an unfolded position wherein the first leg 28 extends downwardly from the first bottom 24 of the first frame member 16. As best illustrated in FIG. 4, the first leg 28 is comprised of a pair of lower struts 30 pivotally attached to the first frame member 16 by a lower spindle 32. An upper spindle 34 also connects the two lower struts 30. A pair of upper struts 36 are pivotally attached to the upper spindle 34 at a medial point on each upper strut 36. A lower cross arm 38 connects the pair of upper struts 36, while an upper cross arm 40 also connects the pair of upper struts 36. One or more brackets 42 are attached to some of the plurality of first slats 26 such that each bracket 42 forms a channel 44 and such that the lower cross arm 38 is confined to travel within the channel 44 so that the brackets 42 define the limits of travel of the upper struts 36 and thus the folding and unfolding of the first leg 28. When the first leg 28 is in the folded position, both the lower pair of struts 30 and the upper pair of struts 36 are positioned within the confines of the first frame member 16 and generally flush against the plurality of first slats 26. In this position, the lower cross arm 38 abuts against the distal end of the channel 44 (the end that is closer to the second end 20 of the first frame member 16). When the first leg 28 is in the unfolded position, the lower struts 30 are pivoted away from the plurality of first slats 26 such that the lower struts 30 angle downwardly from the first bottom 24 of the first frame member 16. The upper struts 36 are pivoted until they extend generally downwardly from the first bottom 24 of the first frame member 16. In this position, the lower cross arm 38 abuts against the proximal end of the channel 44 formed by the bracket 42.

A second frame member 46 has a third end 48 that is hingedly attached to the first end 18 of the first frame member 16 by an appropriate hinge 50, a fourth end 52, a second top 54, and a second bottom 56. A second seating surface is attached to the second top 54 of the second frame member 46. As seen, the second seating surface comprises a plurality of parallel second slats 58 arranged transverse to the longitudinal sides of the second frame member 46 and having spaces between each slat 58. The plurality of first slats 26 and the plurality of second slats 58 are parallel to one another and when the folding bench 10 is in the unfolded position, form an uninterrupted seating area. A second leg 60 is foldably attached to the second frame member 46 such that the second leg 60 articulates between a folded position wherein the second leg 60 is stored within the confines of the second frame member 46 and an unfolded position wherein the second leg 60 extends downwardly from the second bottom 56 of the second frame member 46. The architecture and articulation of the second leg 60 is substantially similar to that of the first leg 28 such that the second leg 60 is comprised of a pair of lower struts 62 pivotally attached to the second frame member 46 by a lower spindle 64. An upper spindle 66 also connects the two lower struts 62. A pair of upper struts 68 are pivotally attached to the upper spindle 66 at a medial point on each upper strut 68. A lower cross arm 70 connects the pair of upper struts 68, while an upper cross arm 72 also connects the pair of upper struts 68. One or more brackets 74 are attached to some of the plurality of second slats 58 such that each bracket 74 forms a channel 76 and such that the lower cross arm 70 is confined to travel within the channel 76 so that the brackets 74 define the limits of travel of the upper struts 68 and thus the folding and unfolding of the second leg 60. When the second leg 60 is in the folded position, both the lower pair of struts 62 and the upper pair of struts 68 are positioned within the confines of the second frame member 46 and generally flush against the plurality of second slats 58. In this position, the lower cross arm 70 abuts against the distal end of the channel 76 (the end that is closer to the fourth end 52 of the second frame member 46. When the second leg 60 is in the unfolded position, the lower struts 62 are pivoted away from the plurality of second slats 58 such that the lower struts 62 angle downwardly from the second bottom 56 of the second frame member 46. The upper struts 68 are pivoted until they extend generally downwardly from the second bottom 56 of the second frame member 46. In this position, the lower cross arm 70 abuts against the proximal end of the channel 76 formed by the bracket 74.

The folding bench 10 articulates between a closed position wherein the first leg 28 and the second leg 60 are each in the folded position and the first bottom 24 of the first frame member 16 faces and abuts the second bottom 56 of the second frame member 46 and an open position wherein the first leg 28 and the second leg 60 are each in the unfolded position and the first seating surface and the second seating surface are located on the same plane and the first end 18 of the first frame member 16 faces the third end 48 of the second frame member 46. One or more latches 78 of any appropriate design are used to latch the first frame member 16 to the second frame member 46 whenever the folding bench 10 is in the closed position.

Between the first frame member 16 and the struts 30 and 36 and brackets 42 of the first leg 28 of the first half 12 sufficient space exists to store various objects O such as the illustrated drink containers. Similarly, sufficient space also exists between the second frame member 46 and the struts 62 and 68 and brackets 74 of the second leg 60 of the second half 14 to also store various objects O. When the folding bench 10 is in the closed position, the depth of the first frame member 16 and the abutting second frame member 46 is sufficient to form a generous sized interior space to hold relatively large objects O. An appropriate retaining means 80 is provided for retaining the objects O stored within the interior space. As seen, the retaining means 80, which may be located on the first half 12, the second half 14, or both can include a bungee cord with appropriate hooks 82, a strap, retainer brackets, etc. The retaining means 80 on the first half 12 may be configured differently than the retaining means 80 on the second half 14 so that each half 12 and 14 can hold different objects O.

A first handle portion 84 is attached to the second end 20 of the first frame member 16 while a second handle portion 86 is attached to the fourth end 52 of the second frame member 46. The first handle portion 84 has one or more first arcuate openings 88 and the second handle portion 86 has one or more second arcuate openings 90 that corresponds with the first openings 88 whenever the folding bench 10 is in the closed position. The first handle portion 84 and the second handle portion 86 form an overall carrying handle whenever the folding bench 10 is in the closed position.

In order to use the folding bench 10 of the present invention, the folding bench 10 is placed into the open position with the first leg 28 and the second leg 60 each in the folded position various objects O are placed into the first half 12, the second half 14, or both. The various retaining means 80 are used to secure the objects O in place as needed. The folding bench 10 is placed into the closed position by bringing the first half 12 and the second half 14 together such that the first bottom 24 of the first frame member 16 faces and abuts the second bottom 56 of the second frame member 46. The two halves 12 and 14 are latched together via the latches 78. The folding bench 10 is carried via the handle formed by the first handle portion 84 and the second handle portion 86. As the folding bench 10 has a relatively slim profile when in the closed position, transport, loading and unloading of the folding bench 10 is relatively simple. Upon arrival at the desired destination, the two halves 12 and 14 are unlatched from one another and the folding bench 10 is unfolded into the open position such that that plurality of first slats 26 and the plurality of second slat 58 rest on the ground. The objects O are unloaded from the two halves 12 and 14 as needed. The first leg 28 and the second leg 60 are each placed into the unfolded position. The folding bench 10 is flipped over so that it rests on the pair of unfolded legs 28 and 60. The users can sit on the plurality of first slats 26 and the plurality of second slats 58 or can use the slats 26 and 58 as a table top. The arcuate openings 88 of the first handle portion 84 and the arcuate openings 90 of the second handle portion 86 can be used as typical cup holders to hold cylindrical objects that have either a lip or a slight taper. When picnic time is over, the folding bench 10 is loaded up, folded up, and the users are on the way back home.

The various structural components of the folding bench 10 (first frame member 16, second frame member 46, first leg 28, second leg 60, first slats 26, second slats 58) can be made from any appropriate sturdy and light material such as plastic, wood, etc. The length of each frame member 16 and 46 can be as long as needed, advantageously, at least sufficiently long to comfortably seat two people, but should be only so long so as to allow the folding bench 10 to be easily carried by the handle portions 84 and 86 whenever the folding bench 10 is in the closed position.

While the invention has been particularly shown and described with reference to an embodiment thereof, it will be appreciated by those skilled in the art that various changes in form and detail may be made without departing from the spirit and scope of the invention.

I claim:

1. A bench comprising:

a first frame member having a first end, a second end, a first top, and a first bottom;

a first leg having a pair of first upper struts pivotally attached to the first frame member and a pair of first lower struts pivotally attached to the pair of first upper struts, the pair of first lower struts having a cross member extending therebetween and traveling within a first channel system created by a pair of first brackets attached to the first bottom such that the first leg articulates between a folded position wherein the pair of first upper struts and the pair of first lower struts are stored within the confines of the first frame member and an unfolded position wherein the pair of first lower struts extend downwardly from the first bottom and the pair of first upper struts extend diagonally between the first frame member and the pair of first lower struts extends downwardly from the first bottom;

a first seating surface attached to the first top;

a second frame member having a third end hingedly attached to the first end, a fourth end, a second top, and a second bottom;

a second leg having a pair of second upper struts pivotally attached to the second frame member and a pair of second lower struts pivotally attached to the pair of second upper struts, the pair of second lower struts having a second cross member extending therebetween and traveling within a second channel system created by a pair of second brackets attached to the second bottom such that the second leg articulates between a folded position wherein the pair of second upper struts and the pair of second lower struts are stored within the confines of the second frame member and an unfolded position wherein the pair of second lower struts extend downwardly from the second bottom and the pair of second upper struts extend diagonally between the second frame member and the pair of second lower struts extends downwardly from the second bottom;

a second seating surface attached to the second top; and wherein the bench articulates between a closed position wherein the first leg and the second leg are each in the folded position and the first bottom of the first frame member faces and abuts the second bottom of the second frame member and an open position wherein the first leg and the second leg are each in the unfolded position and the first seating surface and the second seating surface are located on the same plane.

2. The bench as in claim 1 wherein the first frame member is latched to the second frame member when the bench is in the closed position.

3. The bench as in claim 1 first comprising retaining means for retaining objects within an interior space formed by the abutting first frame member and the second frame member whenever the bench is in the closed position.

4. The bench as in claim 3 wherein the retaining means comprises a strap.

5. The bench as in claim 3 wherein the retaining means comprises a bungee cord.

6. The bench as in claim 1 further comprising a handle attached to the second end of the first frame member.

7. The bench as in claim 1 further comprising:

a first rigid carrying handle portion extending outwardly from the second end of the first frame member; and a second rigid carrying handle portion extending outwardly from the fourth end of the second frame member.

8. The bench as in claim 7 wherein the first carrying handle portion has a first arcuate opening and the second carrying handle has a second arcuate opening that corresponds with the first opening whenever the bench is in the closed position such that the first opening and the second opening are each adapted to receive a cylindrical object therein for storage.

9. The bench as in claim 8 in combination with the received cylindrical object.

10. The bench as in claim 1 wherein the first seating surface comprises a plurality of first slats arranged in parallel with each other and the second seating surface comprises a plurality of second slats arranged in parallel with each other and with the plurality of first slats.

11. A bench comprising:

a first frame member having a first end, a second end, a first top, and a first bottom;

a first leg having a pair of first upper struts pivotally attached to the first frame member and a pair of first lower struts pivotally attached to the pair of first upper struts, the pair of first lower struts having a cross member extending therebetween and traveling within a first channel system created by a pair of first brackets attached to the first bottom such that the first leg articulates between a folded position wherein the pair of first upper struts and the pair of first lower struts are stored within the confines of the first frame member and an unfolded position wherein the pair of first lower struts extend downwardly from the first bottom and the pair of first upper struts extend diagonally between the first frame member and the pair of first lower struts extends downwardly from the first bottom;

a first seating surface attached to the first top;

a second frame member having a third end hingedly attached to the first end, a fourth end, a second top, and a second bottom;

a second leg having a pair of second upper struts pivotally attached to the second frame member and a pair of second lower struts pivotally attached to the pair of second upper struts, the pair of second lower struts having a second cross member extending therebetween and traveling within a second channel system created by a pair of second brackets attached to the second bottom such that the second leg articulates between a folded position wherein the pair of second upper struts and the pair of second lower struts are stored within the confines of the second frame member and an unfolded position wherein the pair of second lower struts extend downwardly from the second bottom and the pair of second upper struts extend diagonally between the second frame member and the pair of second lower struts extends downwardly from the second bottom;

a second seating surface attached to the second top; and wherein the bench articulates between a closed position wherein the first leg and the second leg are each in the folded position and the first bottom of the first frame member faces and abuts the second bottom of the second frame member and an open position wherein the first leg and the second leg are each in the unfolded position and the first end faces the third end.

12. The bench as in claim 11 wherein the first frame member is latched to the second frame member when the bench is in the closed position.

13. The bench as in claim 11 first comprising retaining means for retaining objects within an interior space formed by the abutting first frame member and the second frame member whenever the bench is in the closed position.

14. The bench as in claim 13 wherein the retaining means comprises a strap.

15. The bench as in claim 13 wherein the retaining means comprises a bungee cord.

16. The bench as in claim 11 further comprising a handle attached to the second end of the first frame member.

17. The bench as in claim 11 further comprising:

a first rigid carrying handle portion extending outwardly from the second end of the first frame member; and a second rigid carrying handle portion extending outwardly from the fourth end of the second frame member.

18. The bench as in claim 17 wherein the first carrying handle portion has a first arcuate opening and the second carrying handle has a second arcuate opening that corresponds with the first opening whenever the bench is in the closed position such that the first opening and the second opening are each adapted to receive a cylindrical object therein for storage.

19. The bench as in claim 18 in combination with the received cylindrical object.

20. The bench as in claim 11 wherein the first seating surface comprises a plurality of first slats arranged in parallel with each other and the second seating surface comprises a plurality of second slats arranged in parallel with each other and with the plurality of first slats.

* * * * *